United States Patent [19]

Bøe

[11] Patent Number: 4,889,197

[45] Date of Patent: Dec. 26, 1989

[54] HYDRAULIC OPERATED UNDERREAMER

[75] Inventor: Einar Bøe, Notodden, Norway

[73] Assignee: Norsk Hydro a.s., Oslo, Norway

[21] Appl. No.: 213,287

[22] Filed: Jun. 28, 1988

[30] Foreign Application Priority Data

Jul. 30, 1987 [NO] Norway ..... 873188

[51] Int. Cl.[4] ..... E21B 7/28

[52] U.S. Cl. ..... 175/267; 175/271; 175/285; 175/288

[58] Field of Search ..... 175/263-269, 175/271, 281, 284, 285, 288, 384; 166/55.3, 55.8

[56] References Cited

U.S. PATENT DOCUMENTS

| | | | |
|---|---|---|---|
| 1,485,642 | 3/1924 | Stone | 175/288 X |
| 1,772,710 | 8/1930 | Denney | 175/269 X |
| 1,777,713 | 10/1930 | Braden | 175/269 X |
| 1,804,850 | 5/1931 | Triplett . | |
| 1,839,767 | 1/1932 | Lopez | 175/267 |
| 1,874,880 | 8/1932 | Brotherton et al. | 166/55.8 |
| 2,072,859 | 3/1937 | Grant . | |
| 2,322,695 | 6/1943 | Kinzbach | 175/269 X |
| 2,809,015 | 10/1957 | Phipps | 175/267 X |
| 2,814,463 | 11/1957 | Kammerer, Jr. | 175/267 |
| 3,004,615 | 10/1961 | Schutte | 175/286 |
| 3,051,255 | 8/1962 | Deely | 175/265 |
| 3,331,439 | 7/1967 | Sanford | 175/285 X |
| 4,068,711 | 1/1978 | Anlenbacher | 175/288 X |
| 4,282,941 | 8/1981 | Perkin | 175/267 |

*Primary Examiner*—Hoang C. Dang

*Attorney, Agent, or Firm*—Wenderoth, Lind & Ponack

[57] ABSTRACT

A hydraulically operated underreamer or reamer for enlargement of boreholes is to be connected to a rotating drill string. An outer movable cylinder extends the entire length of the reamer for protection of inner parts thereof. Cutter support arms are movable rectilinearly between an operative state whereat they extend from the cylinder and a closed state whereat they are completely retracted within the cylinder. Cutters are mounted on the support arms and are rectilinearly movable with support arms through openings in the cylinder.

11 Claims, 3 Drawing Sheets

HYDRAULIC OPERATED UNDERREAMER

BACKGROUND OF THE INVENTION

The present invention relates to a hydraulically operated underreamer.

This is a tool that is used to enlarge boreholes. Such tools can be used in drilling oil, gas, water and, in mining, drilling of construction holes and wells and also in the formation of shotholes for blasting. An underreamer has two operative states, one closed or collapsed state where the diameter of the tool is sufficiently small to allow movement of the tool in the narrowest part of the borehole, and one opened or partly expanded state where one or more toolholders (arms) with cutters on the ends thereof pivot out from the body of the tool. In this position the borehole is enlarged as the tool is rotated and lowered.

A drilling type underreamer usually is used in conjunction with a drill bit below the underreamer. The drill bit forms the hole to be underreamed at the same time as the underreamer enlarges the hole formed by the bit. Circulation of drilling fluid must be provided to the drill bit to remove cuttings during the drilling operation.

Underreamers of this type usually have hinged arms (toolholders) that have a tendency to break during the drilling operation and must be fished-up or withdrawn from the borehole. The tool has pockets where the arms are situated in the closed state. These pockets have a tendency to be filled with materials from the drilling operation, which makes collapsing of the arms difficult, thereby providing a substantial chance that the underreamer will become caught or hooked in the borehole, and this will lead to severe problems when attempting to remove the tool. Costs also can be considerable. In addition, this type of reamer is very large and heavy and has a complicated structure composed of many parts. Such type of underreamer is, for example, described in U.S. Pat. No. 4,282,941.

SUMMARY OF THE INVENTION

The object of the invention is to provide an underreamer that is reliable, stable and without risk of being stuck in the borehole, and that has a simple construction and moderate size.

An essential feature of the underreamer of the invention is that it has over its entire length an outer cylinder that protects all movable parts against earth, stones, etc. The cylinder together with a piston movable therein form a slide valve. The cylinder restricts the length of stroke of the piston, and the weight of the cylinder enables self closing of the reamer. The piston is fixed to a pipe of the same dimension as the drilling pipe. The lower part of the piston forms the upper part of a coupling device for transfer of torsional forces to cutter arms. The arms are fixed to the piston by connecting bars. The lower part of the coupling device is a body with a cross section, e.g. triangular, defined by a plurality of planar surfaces having guide grooves for the arms. It is important for the stability of the underreamer that the cutter support arms can be moved in rectilinear directions. When lowering the reamer into a borehole the support arms will be retracted within the cylinder. When mud is pumped down, the support arms with the cutters will be extended outwardly of the cylinder to a required diameter. The reamer has a locking device which prevents the support arms from being extended outwardly by an impact, push, etc. during lowering into the borehole, and also a locking mechanism for locking of the arms in the operative position. Also important for the stability of the reamer is that it is filled with mud and that a negative cutting angle is used.

BRIEF DESCRIPTION OF THE DRAWINGS

Other features of the invention are describe in more detail below with reference to the enclosed drawings, wherein.

DETAILED DESCRIPTION OF THE INVENTION

Figure 1:
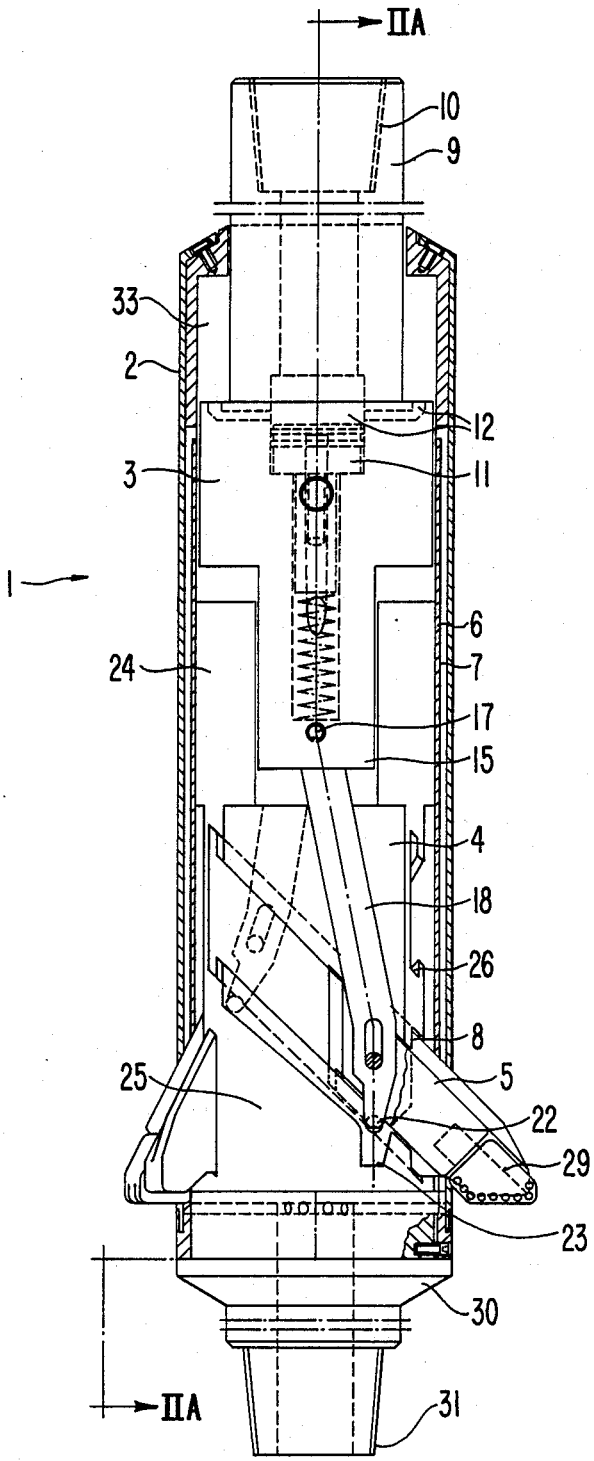
FIG. 1 is an elevation view, partially in longitudinal section, of an underreamer with arms thereof shown in an expanded state.
Figure 2A:
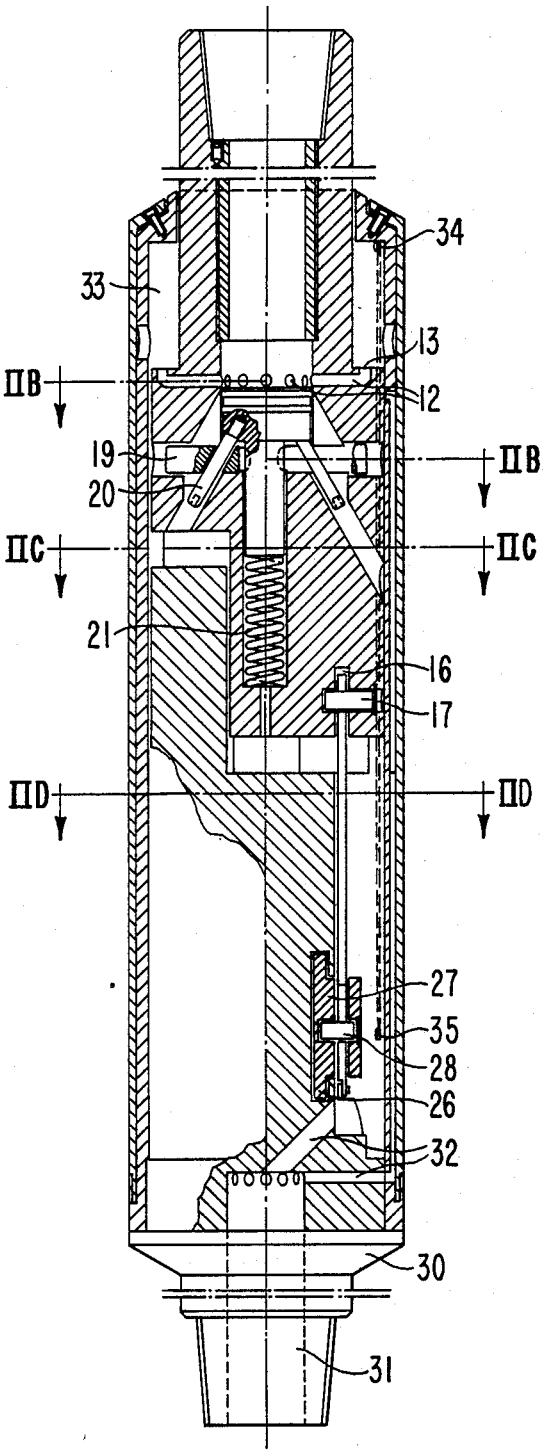
FIG. 2A is a longitudinal section along the line IIA—IIA in FIG. 1.
Figure 2B:
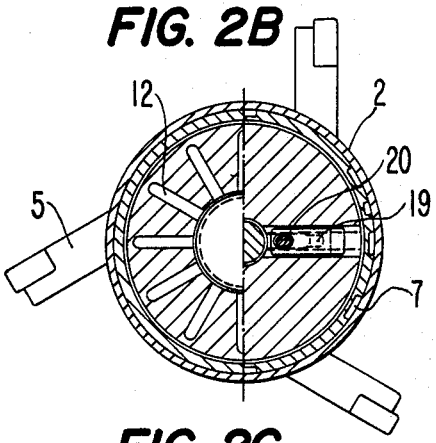
FIG. 2B is transverse cross-sectional view taken along line IIB—IIB in FIG. 2A.
Figure 2C:
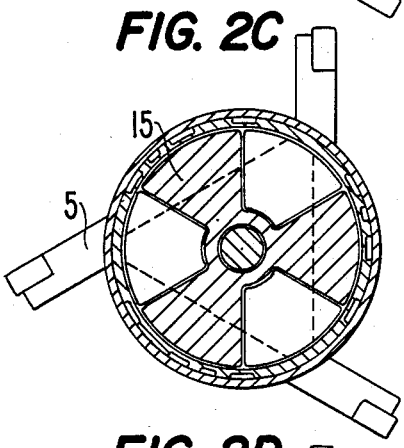
FIG. 2C is a transverse cross-sectional view taken along line IIC—IIC in FIG. 2A.
Figure 2D:
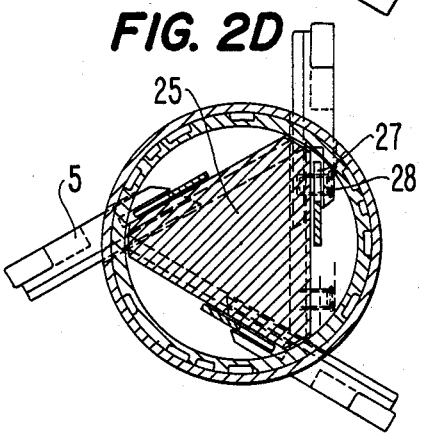
FIG. 2D is a transverse cross-sectional view taken along line IID—IID in FIG. 2A.

A reamer or underreamer 1 includes four main parts, a cylinder including an outer cylinder 2, a piston 3 slidable in the cylinder, supporting body 4 having grooves, and arms 5 fitted in such grooves. In FIGS. 1 and 2 the reamer is shown with the arms 5 extending outwardly from the grooves. Outer cylinder 2 extends over the whole length of the reamer. The cylinder forms a cover for the reamer and protects the movable parts thereof against damage from the drill cuttings. In the drawings, the cylinder is shown to be formed by two concentrically located cylinders 2, 6, with the inner cylinder 6 having grooves 7 which together with the outer cylinder form channels for transportation of mud inside the cover. Because the cylinder is a double structure, the channels for mud in an easy way can be coated with ceramic abrasion resistant material. Alternatively the cylinder can be a single member having extending therethrough bores for passage of mud. In the lower part of the cylinder there are formed openings 8 through which pass the support arms 5. Mud can pass out through the openings 8. During the reaming operation there is overpressure inside the cylinder.

The upper part of the supporting body 4 for the cutter support arms has a circular outer circumference, and the middle part of the supporting body has in this case a triangular profile 25 because the reamer as shown is equipped with three arms 5 and respective cutters 29.

The piston 3 is connected to a pipe 9 of the same dimension and threads 10 as a drilling pipe. The piston 3 has radial channels 12 which have openings 13 opening into a chamber above the piston for inlet of drilling fluid. The number of channels 12 is determined by operating parameters such as flow, pressure loss, etc.

The lower part of the piston 3 and the support part of body 4 define therebetween a claw coupling 15 for transference of torsional forces. In the drawings the coupling is shown with three "claws", the same number as the number of cutters and arms. This number can be varied. The coupling is in the form of circumferentially spaced recesses, e.g. spector-shaped, in the piston into which extend complementary protrusions 24 of the body 4. Each portion of coupling claw of the piston includes a groove 16 and pin 17 for transference of sliding forces through a respective connecting bar 18 to the respective cutter support arm 5. The grooves 16 in the claws of the piston are parallel to the respective faces of the triangular profile 25.

The upper part of the cylinder forms a slide valve together with the piston 3. The cylinder and the lower part of the claw coupling limits the complete stroke and thereby the expansion or degree of extension of the cutter support arms 5. A smaller deflection of the arms can be obtained by several guide tracks cut in the triangular part of the reamer. The weight of the cylinder facilitates self closing. The cylinder can be moved in the vertical direction relative to the piston under influence of the drilling fluid.

Figure 3A:
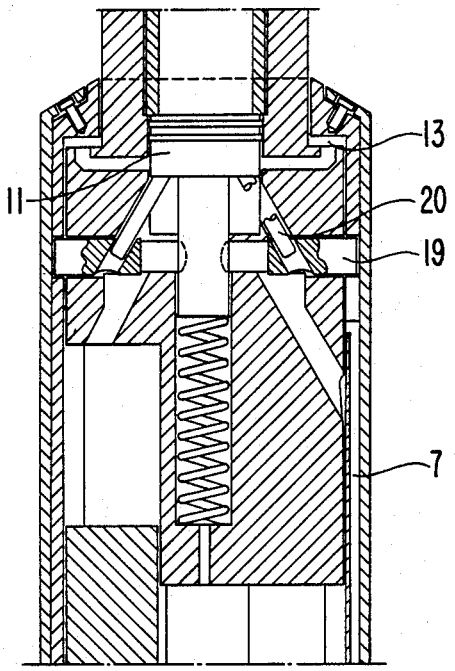
FIG. 3A is a partial section of an upper part of the underreamer, shown in a locked position with support ams retracted.

The piston also is equipped with a locking mechanism to prevent the cutter support arms from projecting outwardly should the tool be subjected to an impact or thrust during lowering thereof into a bore hole. The locking mechanism as shown in the drawings includes a locking piston 11 which is influenced by the pressure of the drilling fluid. The locking piston is arranged in the center of the piston 3 of the reamer. Further, the locking mechanism includes bolts 19 that are radially positioned and guided by guide pins 20. The locking mechanism is supported by a spring 21. In the locked position bolts 19 fit in the grooves in the cylinder and the locking piston closes passage of the drilling fluid to the channels 12 (FIG. 3A).

In the operative position, with the cutter support arms 5 extending outwardly, each arm can be locked by a projection arranged at the lower part of the connecting bar 18 fitting into a groove or recess 23.

In each wall of the triangular profile 25 is milled, at a predetermined angle, a groove 26 for the respective cutter support arm 5. The grooves 26 are arranged in such a way that one can choose between positive and negative cutting angles. Both T-grooves, as shown in the drawings, and dovetailed grooves can be used. This construction provides maximum support and imports minimum moments to the cutter support arms. The body 4 includes, below the triangular profile, a lower circular portion. If more support arms are required, the triangular profile 25 can be replaced with a profile with more side faces.

The cutter support arms 5 can be moved in the grooves and are connected to the respective connecting bars 18 by respective pins 28 fitting in grooves 27 in the connecting bars 18. More than half of the total length of each cutter support arm will remain inside the supporting body 4, and thereby there is provided support during a drilling and reaming operation. The cutting tools of cutters 29 are made with reverse cutters where the cutters are plates fixed to the ends of the cutter support arms in grooves. Each cutter is fixed with screws and can be equipped with diamonds, hard metal or ceramic cutter members.

The lower part of the cylinder can be formed for connection to a drill bit. In FIG. 1 the underreamer is shown with a lower conical portion 30 fixed both to the cylinder and to the body 4 and having threads 31 for fastening to a drilling pipe or drill bit. The lower part of body 4 has therein channels 32 for passage of drilling mud from the underreamer to the drill bit.

Figure 3B:
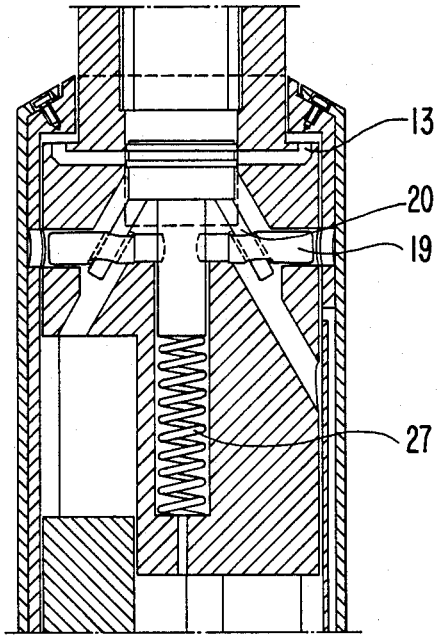
FIG. 3B is a similar view shown in an open position.

When the reamer is suspended by a drilling pipe connected to pipe 9, then the cylinder 2 will move by gravity downwardly relative to piston 3 and the end cover of the cylinder 2 will abut piston 3 as shown in FIGS. 3A and 3B. The cutter support arms 5 will be retracted and be within the reamer structure.

When drilling mud is pumped through the pipe 9 the mud will force the locking piston 11 downwardly and the bolts 19 will be forced out of grooves in the cylinder wall by pins 20 (FIG. 3B). This opens the passage of drilling mud through the channels 12. The mud will exit through the openings 13 and lift the cylinder 2 relative to piston 3, also lifting elements 24, 25 until the two parts 15, 24 of the claw coupling are in complete contact with each other.

Because the cutter support arms 5 are connected to the piston 3 by connecting bars 18, the support arms will be caused to slide in grooves 26 and will project outwardly through openings 8. The projections 22 on the connecting bars will slide into the grooves or recesses 23 and lock the support arms in position. When the underreamer is in operative position, there will be communication between the space 33 and the channels 7 in the cylinder wall. Drilling mud then will pass through the channels 7 and wash the cutter support arms. A part of the drilling mud will pass through channels 32 to a drill bit.

When the underreamer is to be moved out of the bore hole the supply of drilling mud is stopped. The drilling mud will pour out through the channels and through leak holes. A leak hole 34, is provided for emptying of the space 33. When the drill bit is drawn up the piston 3 will slide upwardly relative ot cylinder 2 until the top of the piston abuts the top of the cylinder, and the cutter support arms will be retracted into the cylinder body. The locking piston then will close the further passage of drilling mud into the reamer.

A reamer filled with drilling mud and combined with the use of a negative cutting angle will counteract vibrations and provide stable cutting conditions. The rectilinear movement of the cutter support arms promotes stability.

The operator would be able to notice whether the cutter support arms are in the opened state by observing whether the drilling mud is circulating.

By this construction there is obtained a reamer with good stability. Of importance for good stability is the use of cutter support arms that move rectilinearly and that the reamer is employed with a negative cutting angle. By this construction it is possible to prevent the reamer from being stuck in the bore hole when the reamer is pulled upwardly therein. It is easy to change the cutters and to install spare parts. The underreamer is of small height, low weight and includes fewer parts than reamers presently in use. All movable parts are protected from stones and sand by the outer cylinder and by the over pressure maintained inside the cylinder.

I claim:

1. A hydraulically operated underreamer to be connected to a rotatable drilling pipe for enlarging a drilled hole, said underreamer comprising:

a piston to be connected to the drilling pipe to be rotatable therewith;

a cylinder surrounding said piston and defining therewith a fluid chamber, such that upon introduction of fluid into said chamber said cylinder is axially slidable relative to said piston from a lower first position to an upper second position;

a support body within said cylinder below said piston, said support body being connected to said cylinder;

said piston and said support body having coacting coupling means for enabling said support body to move with said cylinder axially relative to said piston and for preventing relative rotation between said piston and said support body, such that said support body and thereby said cylinder rotate with said piston;

said support body having formed in the exterior thereof a plurality of circumferentailly spaced guides, each said guide extending rectilinearly in a direction at an angle to and not intersecting the longitudinal axis of said piston and said cylinder;

a plurality of cutter support arms, each said arm having a respective cutter and being guided by a respective said guide for rectilinear movement between a withdrawn inoperative position and an extended operative position; and connecting means, operatively connecting said piston and said arms, for, upon said cylinder moving relative to said piston from said first position to said second position and thereby moving said support body axially toward said piston, causing said arms to move along said guides from said inoperative positions to said operative positions.

2. An underreamer as claimed in claim 1, wherein said cylinder extends axially over the entire length of and outwardly encloses said piston and said support body, and said cylinder has therethrough a plurality of circumferentially spaced openings through which outwardly extend said arms in said operative positions thereof.

3. An underreamer as claimed in claim 2, wherein said arms and cutters are entirely withdrawn inwardly of said openings when said arms are in said inoperative positions thereof.

4. An underreamer as claimed in claim 1, wherein said guides comprise grooves formed in said support body, and said arms are slidably fitted in respective said grooves.

5. An underreamer as claimed in claim 1, comprising three said arms and cutters.

6. An underreamer as claimed in claim 1, wherein said connecting means comprise a plurality of connecting bars, each said connecting bar being pivotally connected at a first end thereof to said piston and at a second end thereof to a respective said arm.

7. An underreamer as claimed in claim 6, wherein each said connecting bar has a projection fitting into a respective recess in said supporting body when the respective said arm is in said operative position, thereby locking said arm in said operative position.

8. An underreamer as claimed in claim 1, wherein said support body includes a lower portion defined by a plurality of circumferentially spaced planar surfaces, each said planar surface extending parallel to said longitudinal axis.

9. An underreamer as claimed in claim 8, wherein each said guide comprises a groove formed in a respective said planar surface, and said arms are fitted in respective said grooves.

10. An underreamer as claimed in claim 1, further comprising hydraulically releasable locking means for locking said cylinder in said first position relative to said piston.

11. An underreamer as claimed in claim 10, wherein said locking means comprises at least one bolt mounted in said piston for radial movement between an outer locking position fitting into a groove in said cylinder and an inner unlocking position withdrawn from said groove, a pin for moving said bolt between said locking and unlocking positions, and a locking piston movably mounted within said piston and operatively engaged with said pin for causing said pin to move said bolt between said locking and unlocking positions.

* * * * *